United States Patent [19]

Webster

[11] Patent Number: 4,854,618

[45] Date of Patent: Aug. 8, 1989

[54] MULTI POSITION REVERSIBLE LATCHING ASSEMBLY

[76] Inventor: Desmond E. C. Webster, 346 - 7th Ave. SW., Box 430, Ephrata, Wash. 98823

[21] Appl. No.: 66,832

[22] Filed: Jun. 24, 1987

[51] Int. Cl.[4] ..... E05B 15/02

[52] U.S. Cl. ..... 292/244; 292/337

[58] Field of Search ..... 292/244, 245, 337, 0.60, 292/0.53, 0.51, 34, 36, 37, 170; 70/462, 461, 107, 450; 29/437

[56] References Cited

U.S. PATENT DOCUMENTS

| | | | |
|---|---|---|---|
| 322,505 | 7/1885 | Tighe | 292/244 |
| 332,849 | 12/1885 | Voll | 292/244 |
| 1,739,654 | 12/1929 | Schlage | 292/244 |
| 2,803,481 | 8/1957 | Williams et al. | 292/245 |
| 2,921,461 | 1/1960 | Schlage | 292/337 |
| 3,036,850 | 5/1962 | Schmid | 292/244 |
| 3,121,319 | 2/1964 | Webster | 292/170 X |
| 4,141,234 | 2/1979 | Hoos | 292/244 X |
| 4,606,203 | 8/1986 | Esser | 70/462 X |

FOREIGN PATENT DOCUMENTS

| | | | |
|---|---|---|---|
| 521751 | 8/1953 | Belgium | 292/244 |
| 164120 | 11/1933 | Switzerland | 292/244 |
| 176970 | 3/1922 | United Kingdom | 70/462 |
| 359672 | 10/1931 | United Kingdom | 292/244 |

*Primary Examiner*—Richard E. Moore
*Assistant Examiner*—Curtis B. Brueske
*Attorney, Agent, or Firm*—Hughes & Multer

[57] ABSTRACT

A reversible latch bolt and lock bolt assembly, where the latch bolt has a spring mounted latch bolt member with a slanted contact face. The latch bolt member can be rotated 180° about its horizontal lengthwise axis to position the slanted contact face in either of two orientations. An outer cover plate can be rotated about its vertical center axis to properly receive the latch bolt in either of two positions. Thus, the same latch bolt and lock bolt assembly can be utilized in a door which opens in either an inside or an outside direction. Further, the operating knobs and push buttons are made reversible so that the assembly can be arranged in four different positional combinations.

13 Claims, 5 Drawing Sheets

MULTI POSITION REVERSIBLE LATCHING ASSEMBLY

CROSS REFERENCE TO RELATED APPLICATIONS

This application has been filed concurrently with two other patent applications, namely, "ADJUSTABLE STRIKER PLATE ASSEMBLY," Ser. No. 07/066,825 filed June 24, 1987, and "LATCHING ASSEMBLY WITH PANIC RELEASE," Ser. No. 07/067,232 filed June 24, 1987, having the same inventor as the present application, and the subject matter of these two other concurrently filed applications is hereby incorporated by reference.

BACKGROUND OF THE INVENTION

1. FIELD OF THE INVENTION

The present invention relates to latching assemblies for doors, and more particularly to such a latching assembly where the component parts have multiple positions so that the same latching assembly can be used for various door securing arrangements.

2. BACKGROUND ART

In some instances, a latching assembly is made with a spring mounted latch bolt and a lock bolt. The spring loaded latch bolt is arranged with a slanted contact face and generally always remains in its extended position, unless it is moved inwardly by operation of one of the door handles or buttons, or is moved inwardly by engagement with the striker plate of the door frame. In the latter situation, when the door is moved to the closed position with the spring loaded latch bolt extended, the slanted contact face of the latch bolt engages the striker plate to cause it to retract into the door, with the latch bolt then springing outwardly into its latching position to fit within a latchbolt opening in the striker plate.

On the other hand, the lock bolt remains retracted, except when it is deliberately extended into its locking position. Thus, if the door is opened and the lockbolt is extended, the door cannot be closed until the lock bolt is moved into its retracted position.

Quite often, these latch bolt and lock bolt assemblies are manufactured as a single unit, with these components being provided in a common housing. One of the problems encountered is that for a variety of reasons, doors having similar orientations will not always open in the same direction. For example, if a person is facing a door and finds the hinges of the door to be on the person's right side, and the latching assembly on the left side, that door may open toward the person or away from the person. It is necessary that the latch bolt be properly oriented relative to the direction in which the door opens. More particularly, the slanted face of the latch bolt must be facing in the direction that the door is moved when being closed, so that the latch bolt can engage the striker plate and move to its retracted position during the door closing operation.

Another complication is that on doors that have locking devices, the actuating components of the assembly (e.g. the door handle or the actuating button) will generally differ, depending upon whether those components are on the "outside" or on the "inside" of the door. The term "outside" can be considered as referring to that location where, with the latch assembly in the locked position, the person can only unlock and unlatch the door by use of a key or keys. The "inside" location is that where the person can unlock the latch assembly simply by manually operating a knob or a pushbutton. Thus, not only will the orientation of the spring loaded latch bolt differ, depending upon the opening and closing direction of the door, but also the positioning of the actuating components may be placed on one side or the other of the door, relative to the latch bolt, depending upon such considerations as arrangement of the home or building structure in the doorway area.

To the best knowledge of the applicant herein, commonly such latch assemblies that have two latching and/or locking members in the assembly will be made in at least two different versions to accommodate for these differences or variations as outlined above. This causes the manufacturer the inconvenience of having to supply at least two different types of what are essentially (in terms of function) the same latching assembly. The wholesaler or retailer likewise has the inconvenience of having to carry a larger inventory because of these variations. Further, the end user (e.g. the contractor or the construction worker) either must carry a larger inventory of latch assemblies to be prepared for these different situations, or encounter the difficulty of having to order special latching assemblies, depending upon the particular situation.

Accordingly, it is an object of the present invention to provide such latching assemblies where there are two door-securing components (a door-securing component being either a latch bolt or a dead bolt), where the component parts can be placed in a multiplicity of positions to accommodate the variations outlined above.

SUMMARY OF THE INVENTION

The multiple position latch assembly of the present invention permits a single latch assembly to be arranged in at least four operating configurations. This reduces the need of the supplier of such lock assemblies to carry a larger inventory of latch assemblies to satisfy various operating conditions. Further, this enables the workman or contractor to utilize a single latching assembly for various situations.

One of the bolt members is arranged so that it can face in either of two directions, depending upon the direction in which the door is being closed. Thus, with this bolt member being a latch bolt with a slanted contact face, this latch bolt can be positioned for closing the door in either direction. In addition, the actuating members for the bolt members can be positioned reversibly so that a selected end of the actuating member (generally the end of the actuating member which, in its locked position, can be operated only by a key or other unlocking device) can be positioned at a selected one of two locations (generally an "outside" location).

The multiple positionable latch assembly of the present invention is adapted to be mounted to a door having a front side, rear side, and a lateral edge surface. The latch assembly further has a front to rear longitudinal horizontal axis, a vertical axis, and a lateral axis perpendicular to the longitudinal and vertical axes.

This latch assembly comprises a plate means adapted to be mounted to the edge surface of the door. The plate means comprises a plate member having first and second oppositely positioned major surfaces, an upper end, a lower end and two side edge portions. The plate member further has a vertical center axis and first and second vertically spaced through openings.

There is a first bolt mechanism which is adapted to be positioned in the door, and which has a first bolt member to extend laterally through the first opening of the plate member. There is a second bolt mechanism which is adapted to be positioned in the door and which has a second bolt member to extend laterally through the second opening of the plate member.

The assembly is characterized in that the second bolt member is, in this preferred embodiment, an unsymmetrical bolt member which is unsymmetrical about the vertical axis of the plate member. The second opening is an unsymmetrical opening and is contoured similarly to the unsymmetrical bolt member.

The assembly is arranged in a manner that the plate member can be positioned in its operating position in the door in a manner that with the upper and lower ends being positioned at upper and lower locations of the assembly, respectively, either of the first and second surfaces can be facing laterally outwardly from the latching assembly, so that the plate member is at either of first and second plate positions, respectively.

The second bolt member and the second bolt mechanism are characterized in that with the plate member in the first plate position, the second bolt member can be positioned in a first second bolt member position so that said second bolt member fits in the second opening of the plate member. With the plate member in the second plate position, the second bolt member can be rotated one half of a revolution about a laterally extending axis of the second bolt member to a second position of the second bolt member, so that the second bolt member fits properly in the second opening of the plate member.

Thus, the second bolt member is able to have a first orientation relative to the longitudinal axis in the first second bolt member position, with the plate member in the first plate position, and is able to have a second opposite orientation relative to the longitudinal axis by positioning the second bolt member in the second position of the second bolt member and changing the plate member from the first plate position to the second plate position.

In the preferred form, the second bolt member is a latch bolt which has a slanted contact face and which is resiliently urged to an extended position. Further, the latch bolt is retractable to a retracted position by a force applied to the contact face.

Desirably, the second bolt mechanism for the latch bolt has a laterally extending latch bolt containing portion and a longitudinally extending latch bolt actuating portion. The latch bolt containing portion is characterized in that the latch bolt can be rotated approximately 180° between either of the first and second positions of the second bolt member. The latch bolt containing portion and the latch bolt actuating portion are characterized in that the latch bolt actuating portion is able to function to retract and extend the latch bolt with the latch bolt being in either of the first and second positions of the second bolt member.

The latch bolt actuating portion further has a front end and a rear end. The latch bolt actuating portion is characterized in that it can be positioned with its front end and its rear end reversed, and yet function with the latch bolt containing portion in either of the first and second positions of the second bolt member.

Also, in the preferred form, the first bolt member is a lock bolt whose associated bolt mechanism is a lock bolt subassembly. The lock bolt subassembly comprises a laterally extending lock bolt containing portion and a longitudinally extending lock bolt actuating portion. The actuating portion for the lock bolt has front and rear actuating ends, and the lock bolt subassembly is characterized in that the locations of the first and second lock bolt actuating ends can be reversed with respect to one another.

The preferred form of the plate means is that it comprises a base plate structure adapted to be mounted to the edge surface of the door. The plate member is removably mounted to the base plate structure in a manner to at least partially cover the base plate structure. The plate member is adapted to be mounted to the ball plate structure in either of said first and second plate positions. The plate member is connected to the base plate structure by screw means extending through a connecting opening in the plate member. In the specific configuration shown herein, the screw means comprises at least one screw member having a head with a frusto-conical surface. The connecting opening of the plate member has opposite sides of the connecting opening countersunk, so as to have two opposed frusto-conical opening surface portions. Thus, the head of the screw member is able to fit in said connecting opening with the plate member in either of the first and second plate member positions.

As a further refinement, the assembly comprises a locating plate having a through opening to receive the unsymmetrical bolt member. The locating plate is adapted to be positioned between the flange members of the base plate portion in a locating plate position where upper and lower ends of the locating plate are at upper and lower locations, respectively. The locating plate has a second position where the lower end of the locating plate is at an upper location, and the upper end of the locating plate is at a lower location.

In the method of the present invention, the components are provided as indicated above. The direction in which the door moves to a closed position is ascertained, and the latch bolt is positioned to correspond to the direction in which the door closes.

Further, in the method of the present invention, the actuating member can be positioned in either of two positions so that an "outside" end of the actuating mechanism is properly positioned at the outside location.

Other features of the present invention will become apparent from the following Detailed Description.

BRIEF DESCRIPTION OF THE PREFERRED EMBODIMENT

Figure 1:
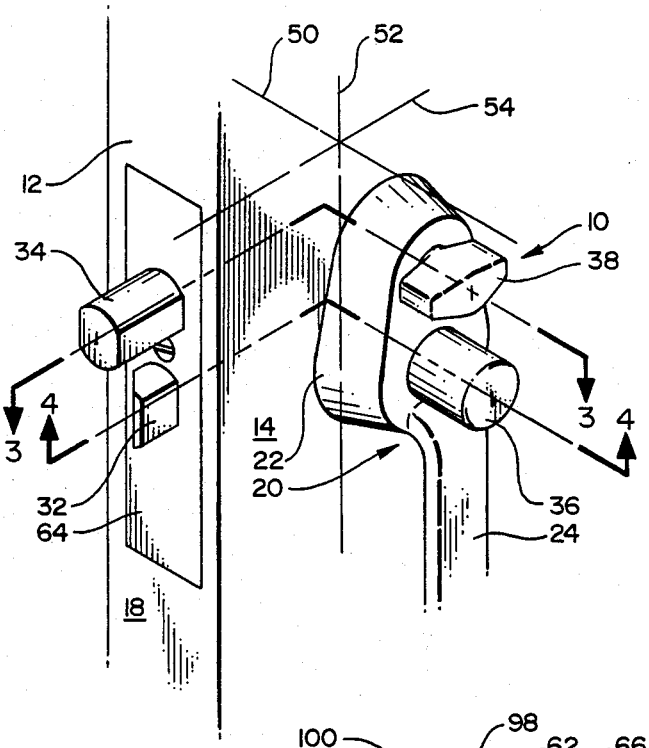
FIG. 1 is an isometric view illustrating a latch assembly of the present invention mounted to a door, with a view taken so as to be looking toward the "inside" location of the assembly.
Figure 2:
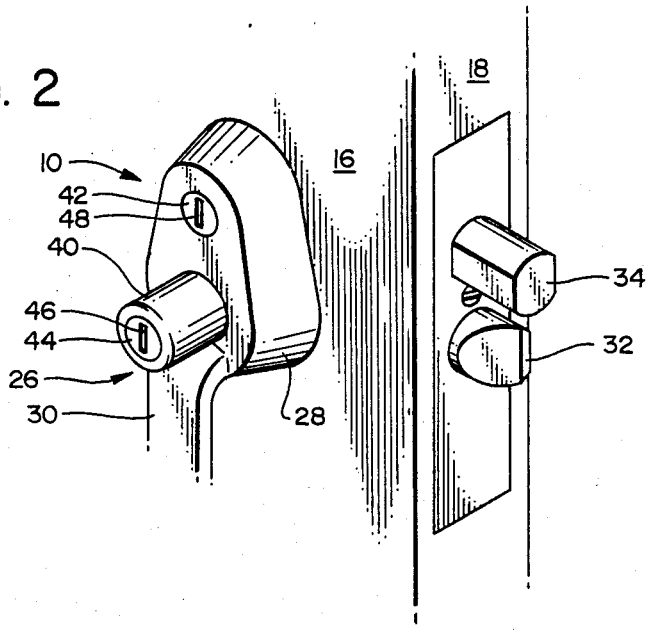
FIG. 2 is a view similar to FIG. 1, but looking at the "outside" of the latching assembly.

With reference to FIGS. 1 and 2, there is shown a latch bolt assembly 10 mounted in a door 12. The door 12 shall be considered as having an "inside" surface or side 14, and "outside" surface or side 16, and a laterally facing vertical edge surface 18. There is an inside handle 20 comprising a base portion 22 and a handle portion 24, and also an outside handle 26, likewise comprising a base portion 28 and a handle portion 30. Extending laterally from the edge surface 18 of the door 12 are a latch bolt 32 and a dead bolt or lock bolt 34. In the following description, the term "bolt member" shall refer to either or both of the latch bolt 32 and the lock bolt 34.

Mounted to the inside handle 20 are an actuating push button or cylinder 36 to operate the latch bolt 32 and also a rotatable knob 38 to retract or extend the lock bolt 34. As its name implies, the push button 36 causes retraction of the latch bolt 32 by pushing the button 36 inwardly. As will be described hereinafter, in this particular configuration, the pushbutton 36 can also be rotated about its lengthwise axis to place the latch bolt portion of the assembly 10 in its locking position.

Mounted to the outside handle 26 is an outside push button or cylinder 40 to retract the latch bolt 32, and a lock barrel 42 to extend or retract the lock bolt 34. The operation of the outside push button 40 is substantially the same as the push button 36, except that the outside push button 40 is provided with a second lock barrel 44. In the event that the latch bolt portion of the assembly 10 is in the locked position, a key must be inserted in the key slot 46 of the lock barrel 44 to turn the lock barrel 44 to its unlocked position, after which the outside push button 40 can be depressed inwardly to retract the latch bolt 32. In like manner, an unlocking device such as a key is inserted into the key slot 48 of the lock barrel 42 and turned to either retract or extend the lock bolt 34.

For purposes of description, the overall assembly will be considered as having a forward to rear horizontally extending longitudinal axis 50, a vertical axis 52, and a transverse or lateral axis 54 that is perpendicular to both the longitudinal and vertical axes 50 and 52.

Figure 3:
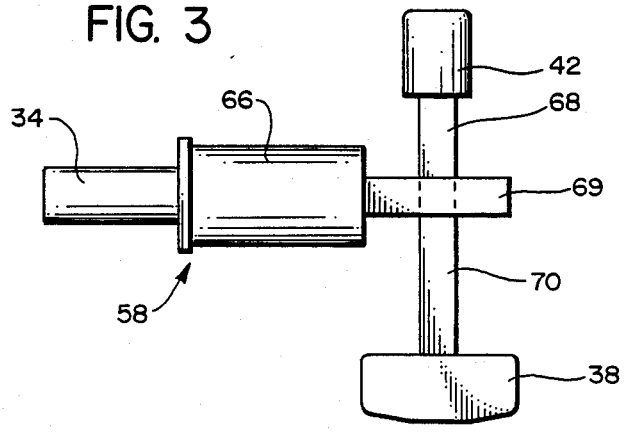
FIG. 3 is a horizontal view, taken partly in section along line 3—3 of FIG. 1, showing only the dead bolt subassembly in plan view.

The assembly 10 further comprises a latch bolt subassembly 56 (see FIG. 4) and a lock bolt subassembly 58 (see FIG. 3). The lock bolt subassembly 58 is or may be, in and of itself, of conventional design. Likewise, the latch bolt subassembly 56 is or may be of conventional design, except that in this specific embodiment there is an added mounting component at the location of the latch bolt 32 itself. The assembly 10 further comprises a mounting plate assembly 60 which is specifically provided for use in the present invention. More particularly, this mounting plate assembly 60 comprises an inner base plate structure 62 and an outer cover plate 64.

The overall operation of the present invention will be described in detail later herein, after a more detailed description of the apparatus of the present invention. However, at present, it may be helpful to indicate, with reference to FIG. 6, that the multi-position or reversible features of the present invention are accomplished, at least in part, by modifying the positions of the cover plate 64 and that portion of the latch bolt subassembly 56 illustrated in FIG. 6. More specifically, the cover plate 64 is rotated 180° about a vertical center axis to a second position, and that portion of the latch bolt assembly 56 that is shown in FIG. 6 is rotated 180° about its horizontal lateral axis to modify the assembly from the position of FIG. 5 to that of FIG. 7. As indicated above, this will be discussed more fully later herein.

As previously stated, the lock bolt subassembly 58 is or may be of conventional design, so it will be described only briefly herein. As illustrated in FIG. 3, the lock bolt assembly comprises the afore-mentioned lock barrel 42, the knob 38, and also the lock bolt 34 itself. The lock bolt 34 is mounted for lateral movement in a lock case or housing 66. The lock barrel 42 is connected through an actuating rod 68 to an actuating mechanism 69 (only the outside structure of which is shown) located inwardly of the lock case 66. Likewise, the handle 38 is connected through a second actuating rod 70 to the same actuating mechanism 69.

Figure 5:
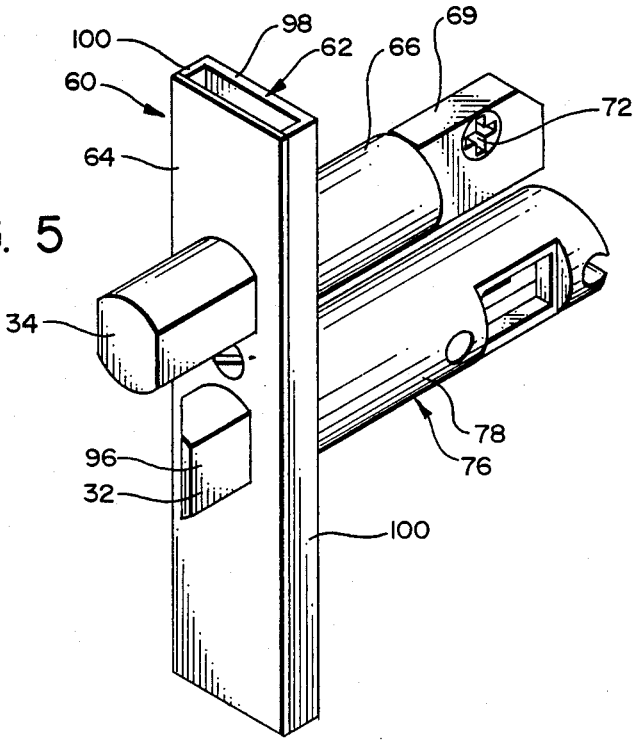
FIG. 5 is an isometric view, taken from the same location as FIG. 1, and showing the portions of the dead bolt subassembly and the latch bolt subassembly without their related actuating components.
Figure 6:
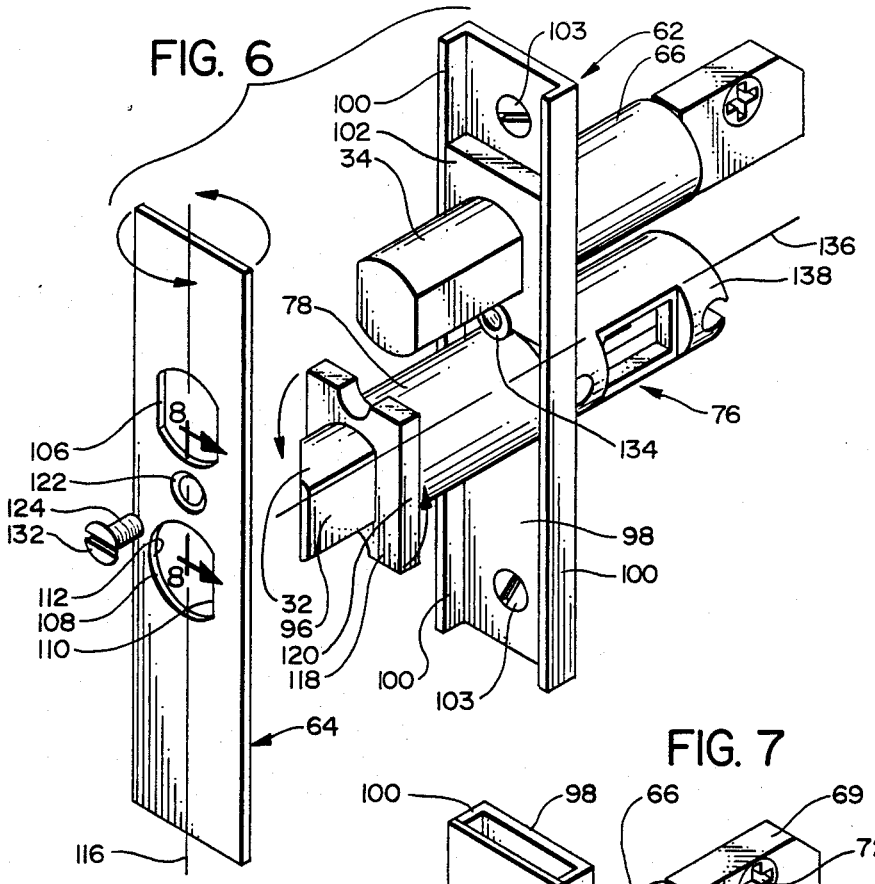
FIG. 6 is a view similar to FIG. 5, but is an exploded view showing the outer closure plate of the assembly removed, and showing the manner in which the outer plate can be reversed and how the latch bolt portion of the latch bolt subassembly can be reversed about a horizontal axis so as to arrive at the arrangement shown in FIG. 7.

As illustrated in FIG. 5, the actuating mechanism 69 has mounted therein a rotatable actuating element 72 which receives both of the actuating rods 68 or 70. This element 72 is arranged so that it can accept either of the rods 68 or 70 on either side of the lock case 66 or can accept a single rod that comprises both of the rods 68 and 70. Thus, it becomes readily apparent that the position of the lock bolt handle 38 and the lock barrel 44 for the lock bolt 38 can have their positions easily reversed.

Figure 4:
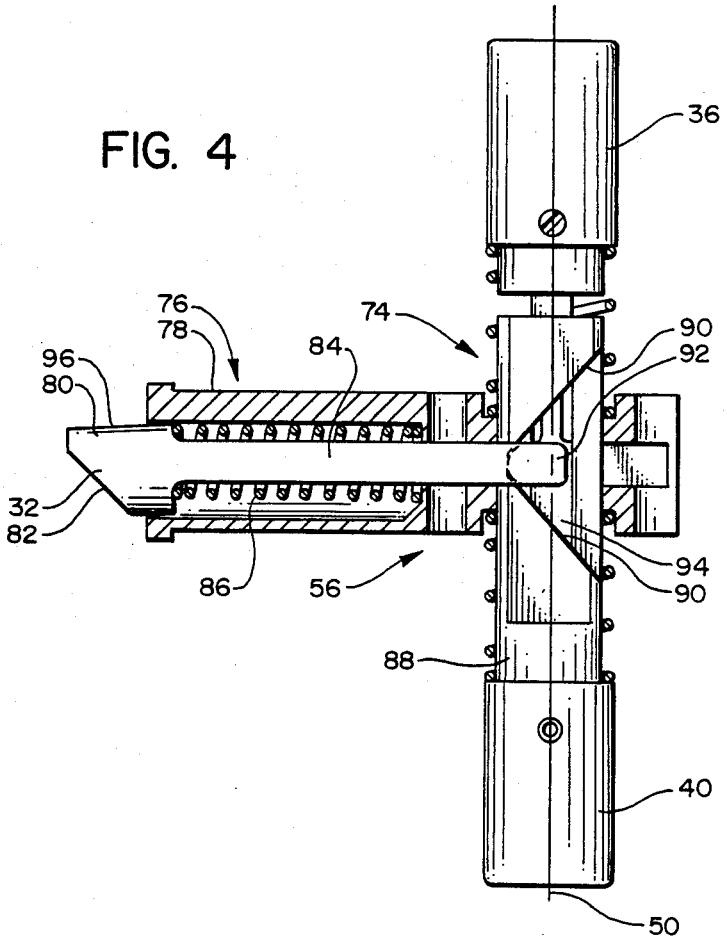
FIG. 4 is a sectional view taken along line 4—4 of FIG. 1, looking upward toward the latch bolt subassembly of the present invention.

The latch bolt subassembly 56 is illustrated in FIG. 4. This latch bolt subassembly 56 can be substantially the same as shown in U.S. Pat. No. 3,121,319, entitled "Closure Fastening Device". The particular latch bolt subassembly shown in FIG. 4 is the same as that disclosed in a copending application by the same inventor as the present invention, filed on the same date as the present invention, and entitled "Latching Assembly With Panic Release".

As illustrated in FIG. 4, this latch bolt subassembly 56 comprises the aforementioned latch bolt 32, the inside push button 36 and the outside push button 40. This subassembly 56 can be considered as comprising a longitudinally aligned actuating section 74 and a transversely or laterally extending latch bolt portion 76. The latch bolt portion 76 comprises a latch case 78 in which the latch bolt 32 is slide mounted. The latch bolt 32 comprises an outer end portion 80 having a slanted contact face 82, and a pair of vertically spaced inwardly extending legs 84. A compression spring 86 is mounted within the case 78 and between the upper and lower legs 84 to urge the latch bolt 34 outwardly to its extended position, as shown in FIG. 4.

The actuating portion 74 comprises a slide bar 88 mounted for back and forth slide motion along the longitudinal axis 50. This slide bar 88 has upper and lower sets of cam faces 90 angled at about 45° to the lengthwise axis of the slide bar 88, and these cam faces 90 engage inwardly protruding portions (not illustrated in FIG. 4) of the inner ends of the two legs 84. It can readily be seen in examining FIG. 4 that when the slide bar 88 is in the intermediate position of FIG. 4, the latch bolt 32 is extended. However, either forward or rearward movement from that intermediate position will cause retraction of the latch bolt 32 by action of the cam faces 90.

Mounted within the slide bar 88 is a locking rod 94. This locking rod has a first horizontal position (shown in FIG. 4) which is the unlocked position. However, by rotating this locking rod 94 90° to a locked position, the retraction of the latch bolt 34 is prevented. The locking rod 94 is rotated 90° between its locking and unlocked positions by manual rotation of the button 36 or by rotation of the lock barrel 44 in the push button 40 by means of a key.

Further, it should be pointed out that the actuating portion 74 is reversible in that it can be rotated 180° about the transverse axis so that the positions of the buttons 36 and 40 can be reversed. This is due to the symmetry of the actuating components at the intermediate portion of the actuating portion 74. Likewise, the latch bolt portion 76 is substantially symmetrical so that it can be rotated 180° about its lengthwise axis (which is parallel to the transverse axis 54 of the assembly 10), and yet function in substantially the same manner relative to the retraction and extension of the latch bolt 32. However, as will be discussed further below, the end portion 80 of the latch bolt 32 is not symmetrical, in that one side of the end portion 80 has the slanted contact face 82, while the opposite side has a surface 96 that is parallel to the transverse axis 54.

With regard to the mounting plate assembly 60 (see FIG. 6), the inner base plate 62 comprises a main vertically aligned plate portion 98 having two outwardly extending edge flanges 100. The base plate 62 further has an upper plate section 102 that can be made integral with the plate section 62 and is made with a through opening to receive the lock bolt 34.

The base plate structure 62 has upper and lower through openings to receive fastening screws 103 by which the base plate 62 can be secured to the structure of the door 12.

The aforementioned cover plate 64 has a rectangular configuration matching that of the base plate structure 62. Further, the cover plate 64 has an upper through opening 106 which has the same configuration as the cross-section of the lock bolt 34, so that the lock bolt 34 can extend through the opening 106 in a reasonably close fit.

The cover plate 64 also has a lower opening 108 to receive the outer end 80 of the latch bolt 32. This opening 108 is non-symmetrical, in that it has one flat vertical edge 110 and a rounded generally vertical edge 112 positioned oppositely to the straight vertical edge 110. Thus, the opening 108 is arranged so that the straight edge portion 110 is positioned adjacent to the laterally aligned flat surface 96 of the latch bolt end portion 80, while the opposite edge portion 112 fits closely against a rounded edge portion 114 that is spaced inwardly from the contact face 82.

The cover plate 64 has a vertical center axis 116. The upper opening 106 is centered on this vertical axis 116 and is shaped symmetrically about this vertical axis 116. On the other hand, the opening 108, while being generally centered on the vertical axis 116 is not symmetrical about that axis 116.

However, the plate opening 108 can be symmetrically shaped about the vertical axis 116 if the latch bolt 32 is symmetrically shaped relative to the cross-sectional configuration of the latch bolt 32 at the location of the plate 64 when the latch bolt is in its extended position, and further provided that the rest of the latch bolt 32 which extends outwardly from the plate 100 has its cross-sectional configuration within the confines of the cross-sectional configuration at the location of the plate 64. However, the latch bolt 32 would still lack complete symmetry since the contact face 82 of the latch bolt 34 would not be symmetrical relative to the latch bolt surface 96.

At the outer end of the latch bolt case 78 there is a positioning plate 118. This plate 118 is fixedly connected to the latch bolt case 78, and the side edges 120 of the plate 118 fit snugly within the two flanges 100 of the base plate structure 62.

Figure 8:
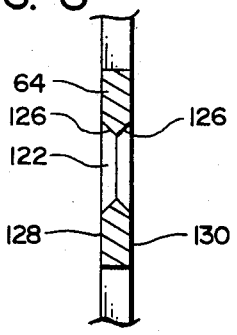
FIG. 8 is a sectional view taken along line 8—8 of FIG. 6, and showing the configuration of the opening in the outer closure plate to receive the retainer screw.

To mount the cover plate 64 to the base plate structure 62, the cover plate 64 is provided with a center through opening 122 to receive a retaining screw 124. As illustrated in FIG. 8, the opening 122 has its circumferential edge countersunk from both sides to provide two conical surfaces 126. Thus, if either of the two main surfaces 128 or 130 of the surface plate 64 is facing outwardly, the head 132 of the screw 124 can come into proper engagement with one or the other of the surfaces 126.

To describe the operation of the present invention, let it be assumed that the door as shown in FIGS. 1 and 2 opens toward the "inside" (i.e. opens towards the viewer who is looking toward the door as shown in FIG. 1). In that instance, the latch bolt 32 is positioned so that its slanted contact face 82 is facing toward the "outside" of the door, so that the door 12 is opened toward the "inside". Accordingly, when the door 12 is slammed shut without depressing either of the buttons 36 or 40 to retract the latch bolt 32, the contact face 80 engaging a striker plate of the door frame will depress the latch bolt 32 and permit the door 12 to close, with the latch bolt 32 then springing outwardly into engagement with the latch bolt opening in the striker plate. However, let it be assumed that the building structure is such that the door 12 is to be mounted so that it swings open in an "outside" direction (i.e. swings from a closed location in FIG. 1 away from the viewer looking toward the door as shown in FIG. 1). To permit the latch bolt 32 to operate properly, it is necessary that the latch bolt 32 be positioned so that the contact face 80 of the latch bolt 32 faces in an "inside" direction, (i.e. in the position illustrated in FIG. 7).

This reversal is accomplished as illustrated in FIG. 6. First, the screw 124 is removed from a threaded socket 134 provided in the base plate structure 62 at a location between the lock bolt 34 and the latch bolt 32. The cover plate 64 is simply moved out of contact with the latch bolt 32 and the lock bolt 34 and rotated 180° about its center vertical axis 116. Then, the latch bolt portion 76 of the latch bolt subassembly 56 is rotated 180° about its laterally extending lengthwise axis 136 (see FIG. 6). (As indicated previously, the inner end portion 138 of the latch bolt portion 76 is made substantially symmetrical so that this latch bolt portion 76 will function properly with the latch bolt actuating portion 74 in either the position shown in FIG. 6 or in the inverted position shown in FIG. 7.)

Figure 7:
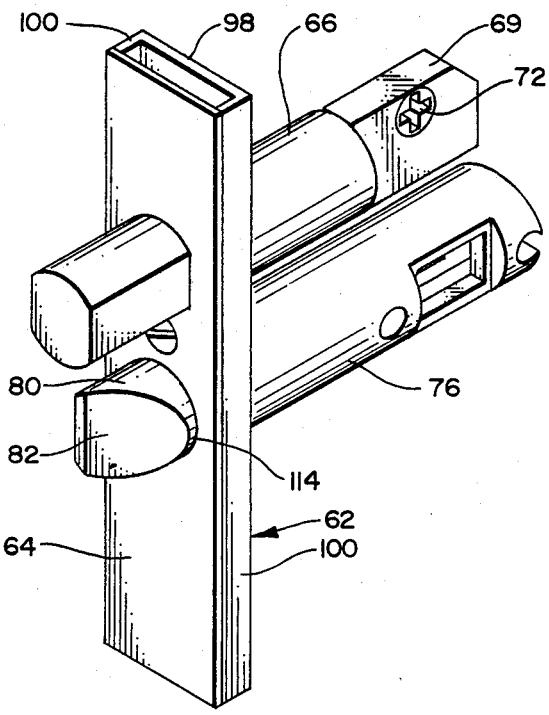
FIG. 7 is a view similar to FIG. 5, but showing the latch bolt subassembly reversed from the location of FIG. 5.

Then the cover plate 64 is moved back to its assembled position, and the latch bolt opening 108 is oriented so as to receive, and properly fit with, the latch bolt end portion 80, as shown in FIG. 7. The screw 124 is then replaced to secure the cover plate 64 in place. However, if the latch bolt 32 and the opening 108 are both symmetrically shaped about the vertical center axis 116, it would not be necessary to rotate the plate 64 about the axis 116.

To discuss another facet of the operation of the present invention, it was indicated previously that the two actuating components for the lock bolt subassembly 58 are both reversible. Thus, the inside knob 38 and the lock barrel 42 can have their positions reversed simply by removing these components from the lock bolt case 66 and exchanging the position of those two components.

Further, as indicated previously, the locations of the "inside" pushbutton 36 and the "outside" pushbutton 40 of the latch bolt subassembly 56 can be reversed simply by rotating the actuating portion 76 of the latch bolt subassembly 56 about the lateral axis 54 so that the positions of the two push buttons 36 and 40 are reversed.

It now becomes readily apparent that the latch bolt assembly 10 can be assembled in four different positional arrangements. Thus, the same assembly 10 can be used, regardless of the direction in which the door swings outwardly from its closed position, and regardless of which side of the door is to be the "outside" (and thus have the key actuated components), or the "inside" (and thus have the manually actuated locking and unlocking components).

Figure 9:
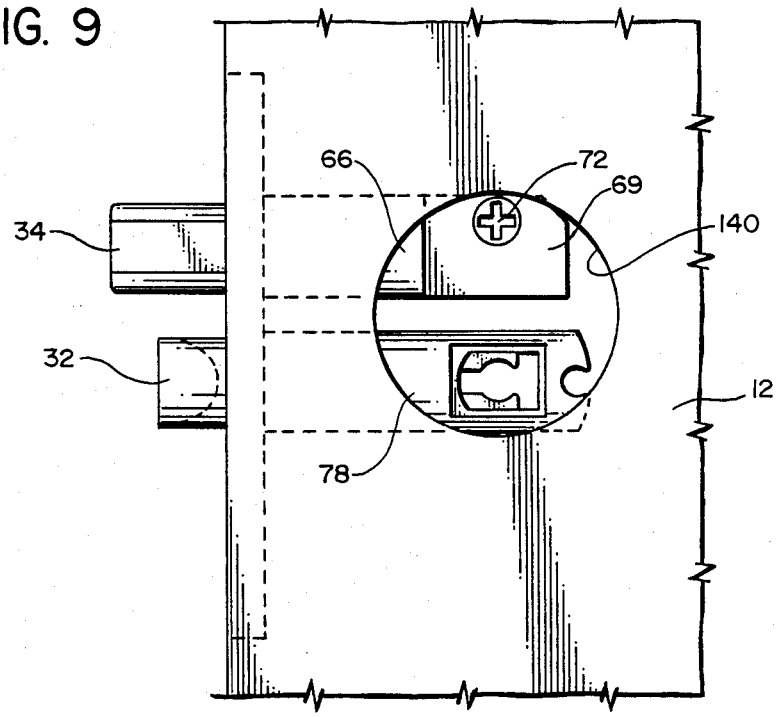
FIG. 9 is an elevational view illustrating the dead bolt and the latch bolt mounted in a door having a standard size (i.e. two and one eighth inch diameter) through hole, with the actuating members of the dead bolt and the latch bolt not shown.

To illustrate another advantage of the present invention, reference is made to FIG. 9, which shows the door 12 having a front-to-rear through circular opening 140. Most doors which are manufactured in the United States are provided with a standard size front-to-rear through opening which is two and one-eighth inch in diameter. In the prior art latching and locking devices which are known to the applicant, it is generally necessary to have two such openings 140, one to accommodate the latch bolt portion, and the other to accommodate the lock bolt or dead bolt portion. However, in the present invention, it is possible to place the total assembly 10 so that both the latch bolt subassembly 56 and the lock bolt subassembly 58 can be positioned so that the actuating components for both of these subassemblies 56 and 58 can be positioned in the single through opening 140.

It is to be understood that the latch bolt subassembly 56 and the lock bolt subassembly 58 are, or may be, in and of themselves, prior art subassemblies, and the particular configurations shown herein are provided simply to illustrate types of subassemblies which would be suitable for use in the presentation. This is done with the understanding that other such latch bolt and lock bolt subassemblies could also be used in the present invention. Further, various modifications could be made to the assembly 10 of the present invention without departing from the basic teachings thereof.

What is claimed is:

1. A multiple positionable latch assembly adapted to be mounted to a door having a front side, a rear side, and a lateral edge surface, said latch assembly further having a front to rear longitudinal horizontal axis, a vertical axis, and a lateral axis perpendicular to the longitudinal and vertical axes, said latch assembly comprising:

a. a plate means adapted to be mounted to the edge surface of the door, said plate means comprising a plate member having first and second oppositely positioned major surfaces, an upper end, a lower end and two side edge portions, said plate member further having a vertical center axis and first and second vertically spaced through openings;

b. a first bolt mechanism adapted to be positioned in said door and having a first bolt member to extend laterally through the first opening of the plate member;

c. a second bolt mechanism adapted to be positioned in said door and having a second bolt member to extend laterally through the second opening of the plate member;

d. said assembly being characterized in that the second bolt member is an asymmetrical bolt member which is asymmetrical about said vertical axis of the plate member and said second opening is an asymmetrical opening and is contoured similarly to said asymmetrical bolt member;

e. said assembly being arranged in a manner that said plate member can be positioned in its operating position in the door in a manner that when its upper and lower ends are positioned at upper and lower locations of the assembly, respectively, either of said first and second surfaces can be facing laterally outwardly from said latching assembly, so that the plate member is at either of first and second plate positions, respectively;

f. said second bolt member and the second bolt mechanism being characterized in that with said plate member in said first plate position, said second bolt member can be positioned in a first second bolt member position so that said second bolt member fits in the second opening of the plate member, and with said plate member in said second plate position, said second bolt member can be rotated one half of a revolution about a laterally extending axis of said second bolt member to a second position of said second bolt member, so that said second bolt member fits properly in said second opening of the plate member;

whereby said second bolt member is able to have a first orientation relative to said longitudinal axis in said first second bolt member position with the plate member in said first plate position, and is able to have a second opposite orientation relative to said longitudinal axis by positioning said second bolt member in said second position of the second bolt member and changing said plate member from said first plate position to said second plate position.

2. The assembly as recited in claim 1, wherein said second bolt member is a latch bolt which has a slanted contact face and is resiliently urged to an extended position, but retractable to a retracted position by a force applied to said contact face.

3. The assembly as recited in claim 2, wherein the second bolt mechanism for the latch bolt has a laterally extending latch bolt containing portion and a longitudinally extending latch bolt actuating portion, said latch bolt containing portion being characterized in that the latch bolt can be rotated approximately 180° between either of said first and second positions of the second bolt member, said latch bolt containing portion and said latch bolt actuating portion being characterized in that said latch bolt actuating portion is able to function to retract and extend said latch bolt with the latch bolt portion being in either of the first and second positions of the second bolt member.

4. The assembly as recited in claim 3, wherein said latch bolt actuating portion has a front end and a rear end, and said latch bolt actuating portion is characterized in that it can be positioned with its front end and its rear end reversed, and yet function with the latch bolt containing portion in either of said first and second positions of the second bolt member.

5. The assembly as recited in claim 2, wherein the first bolt member is a lock bolt whose associated bolt mechanism is a lock bolt subassembly, said lock bolt subassembly comprising a laterally extending lock bolt containing portion, and a longitudinally extending lock bolt actuating portion.

6. The assembly as recited in claim 5, wherein said lock bolt actuating portion has front and rear lock bolt actuating ends, and said lock bolt subassembly is characterized in that the locations of the first and second lock bolt actuating ends can be reversed with respect to one another.

7. The assembly as recited in claim 1, wherein said plate means further comprises a base plate structure adapted to be mounted to the edge surface of the door, said plate member being removably mounted to said base plate structure in a manner to at least partially cover said base plate structure, said plate member being adapted to be mounted to said base plate structure in either of said first and second plate positions.

8. The assembly as recited in claim 7, wherein said plate member is connected to said base plate structure by screw means extending through a connecting opening in said plate member.

9. The assembly as recited in claim 8, wherein said screw means comprises at least one screw member having a head with a frusto-conical surface, the connecting opening of the plate member having opposite sides of said connecting opening counter sunk, so as to have two opposed frusto-conical opening surface portions, so that the head of the screw member is able to properly fit in said connecting opening with the plate member in either of the first and second plate member positions.

10. The assembly as recited in claim 7, wherein said assembly further comprises a locating plate having a through opening to receive said asymmetrical bolt member, said locating plate being adapted to be positioned between said flange members in a locating plate position where upper and lower ends of the locating plate are at upper and lower locations respectively, and a second locating plate position, where the lower end of the locating plate is at an upper location, and the upper end of the locating plate is at a lower location.

11. The assembly as recited in claim 1, wherein:

a. said second bolt member is a latch bolt which has a slanted contact face and is resiliently urged to an extended position, but retractable to a retracted position by a force applied to said contact face;

b. the second bolt mechanism for the latch bolt has a laterally extending latch bolt containing portion and a longitudinally extending latch bolt actuating portion, said latch bolt containing portion being characterized in that the latch bolt can be rotated approximately 180° between either of said first and second positions of the second bolt member, said latch bolt containing portion and said latch bolt actuating portion being characterized in that said latch bolt actuating portion is able to function to retract and extend said latch bolt with the latch bolt portion being in either of the first and second positions of the second bolt member;

c. said latch bolt actuating portion has a front end and a rear end, and said latch bolt actuating portion is characterized in that it can be positioned with its front end and its rear end reversed, and yet function with the latch bolt containing portion in either of said first and second positions of the second bolt member;

d. the first bolt member is a lock bolt whose associated bolt mechanism is a lock bolt subassembly, said lock bolt subassembly comprising a laterally extending lock bolt containing portion, and a longitudinally extending lock bolt actuating portion; and e. said lock bolt actuating portion has front and rear lock bolt actuating ends, and said lock bolt subassembly is characterized in that the locations of the first and second lock bolt actuating ends can be reversed with respect to one another.

12. The assembly as recited in claim 11, wherein:

a. said plate means further comprises a base plate structure adapted to be mounted to the edge surface of the door, said plate member being removably mounted to said base plate structure in a manner to at least partially cover said base plate structure, said plate member being adapted to be mounted to said base plate structure in either of said first and second plate positions; and b. said assembly further comprises a locating plate having a through opening to receive said asymmetrical bolt member, said locating plate being adapted to be positioned between said flange members in a locating plate position where upper and lower ends of the locating plate are at upper and lower locations respectively, and a second locating plate position, where the lower end of the locating plate is at an upper location, and the upper end of the locating plate is at a lower location.

13. The assembly as recited in claim 12, wherein:

a. said plate member is connected to said base plate structure by screw means extending through a connecting opening in said plate member; and b. said screw means comprises at least one screw member having a head with a frusto-conical surface, the connecting opening of the plate member having opposite sides of said connecting opening counter sunk, so as to have two opposed frusto-conical opening surface portions, so that the head of the screw member is able to properly fit in said connecting opening with the plate member in either of the first and second plate member positions.

* * * * *